US005343879A

United States Patent [19]

Teague

[11] Patent Number: 5,343,879

[45] Date of Patent: Sep. 6, 1994

[54] TOBACCO TREATMENT PROCESS

[75] Inventor: Richard A. Teague, Pfafftown, N.C.

[73] Assignee: R. J. Reynolds Tobacco Company, Winston-Salem, N.C.

[21] Appl. No.: 721,860

[22] Filed: Jun. 21, 1991

[51] Int. Cl.[5] ..... A24B 15/20; A24B 15/24; A24B 15/26

[52] U.S. Cl. ..... 131/297; 131/300; 131/298

[58] Field of Search ..... 131/290, 297, 298, 300, 131/311

[56] References Cited

U.S. PATENT DOCUMENTS

| | | | |
|---|---|---|---|
| 3,132,651 | 5/1964 | Kiefer . | |
| 3,240,214 | 3/1966 | Bavley et al. . | |
| 3,513,857 | 5/1970 | Silberman . | |
| 3,636,097 | 1/1972 | Harvey . | |
| 3,747,608 | 7/1973 | Gravely et al. . | |
| 4,135,521 | 1/1979 | Malan et al. . | |
| 4,289,147 | 9/1981 | Wildman et al. . | |
| 4,307,733 | 12/1981 | Teng et al. . | |
| 4,308,877 | 1/1982 | Mattina . | |
| 4,347,324 | 8/1982 | Wildman et al. . | |
| 4,407,307 | 10/1983 | Gaisch et al. . | |
| 4,476,881 | 10/1984 | Gravely et al. . | |
| 4,537,204 | 8/1985 | Gaisch et al. . | |
| 4,572,219 | 2/1986 | Gaisch et al. . | |
| 4,700,727 | 10/1987 | Torigian . | |
| 4,709,710 | 12/1987 | Gaisch et al. . | |
| 4,716,911 | 1/1988 | Poulose et al. . | |
| 4,887,618 | 12/1989 | Bernasek et al. . | |
| 4,941,484 | 7/1990 | Clapp et al. . | |
| 4,986,286 | 1/1991 | Roberts et al. | 131/290 |
| 5,025,812 | 6/1991 | Fagg et al. | 131/297 |

FOREIGN PATENT DOCUMENTS

| | | |
|---|---|---|
| 0117189 | 7/1984 | European Pat. Off. . |
| 2069814 | 9/1981 | United Kingdom . |

*Primary Examiner*—V. Millin
*Assistant Examiner*—J. Doyle

[57] ABSTRACT

Aqueous tobacco extracts are provided by subjecting finely ground tobacco laminae to extraction conditions in the presence of an aqueous solvent and an active enzyme. Then, the enzyme is deactivated, and a liquid aqueous tobacco extract is separated from the insoluble tobacco pulp which remains. The liquid extract is collected and used as a form of tobacco for smoking article manufacture.

6 Claims, 1 Drawing Sheet

TOBACCO TREATMENT PROCESS

BACKGROUND OF THE INVENTION

The present invention relates to tobacco extracts for cigarettes and other types of smoking articles, and in particular, to processes for providing such extracts.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee, et al.; 4,756,318 to Clearman, et al.; 4,793,365 to Sensabaugh, Jr., et al.; 4,854,311 to Banerjee, et al.; and 4,881,556 to Clearman, et al.; propose cigarettes and pipes which comprise a fuel element, an aerosol generating means physically separate from the fuel element, and a separate mouthend piece. Such types of smoking articles provide natural tobacco flavors to the smoker thereof by heating, without necessarily burning, tobacco in various forms. As natural tobacco flavors are important components of smoking articles in order that such smoking articles can provide adequate tobacco taste and aroma, improved processes for providing natural tobacco flavor substances and flavorful forms of tobacco are desirable.

It would be highly desirable to provide a process for efficiently and effectively producing tobacco extracts.

SUMMARY OF THE INVENTION

The present invention relates to a process for providing a tobacco extract. The process involves extracting certain components of a tobacco material from that material using a suitable extraction solvent (e.g., a liquid having an aqueous character) in the presence of at least one enzyme capable of enzymatically degrading components of the biopolymer matrix of the tobacco material. The tobacco material is subjected to extraction conditions in the presence of solvent and active enzyme such that tobacco components soluble or dispersible in the solvent are extracted thereby; the enzyme is deactivated; the solvent and tobacco extract therein (e.g., carried thereby) are separated from that portion of the tobacco material which is not extracted by the solvent (i.e., an insoluble pulp or extracted tobacco material); and a liquid tobacco extract is collected. Preferably, the liquid tobacco extract which is collected is absent of significant quantities of insoluble tobacco pulp, insoluble precipitates, and other insoluble components.

The solvent and tobacco extract which is provided according to the process of the present invention can be used as such or further processed. In particular, the solvent containing tobacco extract, which is collected can be used as such in liquid form. Alternatively, the solvent containing tobacco extract can be processed to remove significant amounts of solvent therefrom (e.g., by spray drying or freeze drying techniques), or otherwise processed (e.g., subjected to heat treatment), prior to use.

DETAILED DESCRIPTION OF THE PREFERRED EMBODIMENTS

Figure 1:
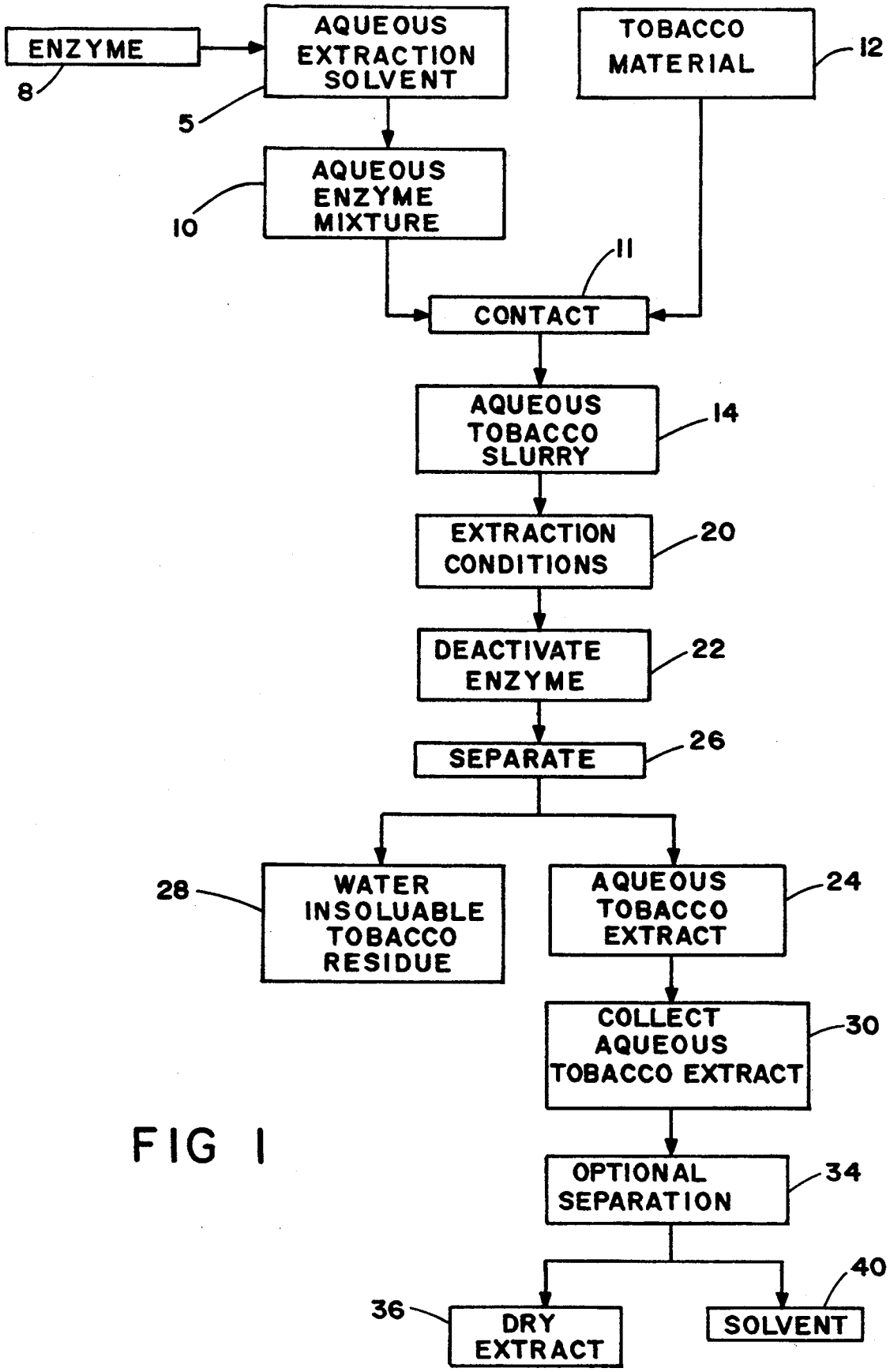
FIG. 1 is a schematic diagram of process steps representative of an embodiment of the present invention.

Referring to FIG. 1, extraction solvents having an aqueous character is contacted with an enzyme 8 or enzyme mixture resulting in an aqueous enzyme mixture 10. The aqueous enzyme mixture is contacted 11 with tobacco material 12. As such, various soluble components are extracted from the tobacco material 12 yielding an aqueous tobacco slurry 14. The temperature, pH and other such conditions are controlled 18 so that the enzyme is activated and is available to digest or decompose components of the water insoluble biopolymer matrix of the tobacco material. As such, the tobacco material is subjected to extraction conditions 20 in the presence of the aqueous solvent and active enzyme. The extraction conditions are maintained for a desired period of time, and then the activity of the enzyme is terminated 22 (e.g., by rapidly heating the slurry). Aqueous tobacco extract 24 is separated 26 from water insoluble tobacco residue 28 using centrifugation techniques, or the like. As such, an aqueous tobacco extract is collected 30. The liquid aqueous tobacco extract optionally is separated 34 from a significant amount of the solvent by distillation techniques followed by spray drying techniques, or the like. Resulting isolated, processed tobacco extract 36 is in a relatively low solvent form from the solvent 40.

The tobacco materials which are processed according to the present invention can vary. Tobacco materials which are used are of a form such that, under extraction conditions, a portion thereof if soluble or dispersible in (i.e., extracted by) the extraction solvent; and a portion thereof is insoluble in (i.e., not extracted by) that extraction solvent. Examples of suitable types of tobaccos include flue-cured, Burley, Maryland and Oriental tobaccos, as well as the rare or specialty tobaccos. The tobacco material generally has been aged, and can be in the form of laminae and/or stem, or can be in processed form. Tobacco waste materials and processing by-products such as fines, dust, scrap, stems and stalks can be employed. The aforementioned tobacco materials can be processed separately, or as blends thereof.

The tobacco material can be physically processed prior to being subjected to extraction conditions. In a preferred aspect, the tobacco material can be ground, milled or otherwise processed to provide particles of tobacco material having a fine particle size and high surface area. Methods for providing tobacco material in a fine powder or particulate form will be apparent to the skilled artisan. Preferred tobacco material is provided at an average particle size of less than about 40 U.S. mesh, often less than about 80 U.S. mesh, and frequently between about 40 U.S. mesh and about 100 U.S. mesh.

The tobacco material is subjected to extraction conditions in the presence of an extraction solvent so as to extract tobacco components from the tobacco material. The tobacco extract is provided by extracting the tobacco material using a liquid having an aqueous character. Such a liquid consists primarily of water, normally greater than about 90 weight percent water, and can be essentially pure water in certain circumstances. For example, a solvent having an aqueous character can be deionized water, distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent mixture of water and minor amounts of one or more solvents which are miscible therewith.

The amount of tobacco material which is contacted with the solvent can vary. However, it is desirable to employ a minimal amount of solvent so as to provide as high an extraction efficiency as possible. Typically, the weight of solvent relative to tobacco material is greater than about 4:1, oftentimes greater than about 5:1, and frequently is greater than about 8:1. Normally, the amount of solvent relative to tobacco material does not exceed about 20:1, and usually does not exceed about 15:1. The amount of solvent relative to tobacco material can vary depending upon factors such as extraction temperature, the type and form of the tobacco material, the manner in which extraction is performed, tobacco particle size and other such factors.

The enzyme employed is an enzyme which can digest or decompose polymeric constituents and other essentially water insoluble high molecular weight components of the tobacco material in such a way that extractable components of the tobacco material can be extracted readily by the solvent. In addition, components of the tobacco material which are enzymatic digestion or decomposition products also can be extracted by the solvent. That is, such decomposition products, which often have desirable flavor characteristics, often are solubilized or dispersed in the solvent and hence can provide a portion of the ultimate extract. Examples of suitable enzymes are set forth in U.S. Pat. No. 4,887,618 to Bernasek, et al., which is incorporated herein by reference. Examples of suitable enzymes include the celluloses, hemi-celluloses, arabanases, B-glucanases, xylanases, pectinesterases, pectintranseliminases, polygalacturonases, alpha-amylases, lipases and the like, and mixtures thereof. Mixtures of enzymes provide a decomposition of pectines, short chain fatty acids, proteins, as well as cellulosics and other polysaccharide materials.

According to the process of the present invention, the solvent and tobacco material are contacted under extraction conditions in the presence of at least one enzyme. The manner in which the tobacco material, solvent and enzyme are contacted with one another can vary, but it is convenient to add the tobacco material to a mixture of solvent and enzyme. The conditions under which the extraction is performed involves factors such as the pH of the tobacco/solvent slurry, the degree of agitation of the slurry, the temperature of the slurry, and the amount and types of enzyme. Typically, the pH of the slurry is maintained at about 3 to about 12, preferably about 3.5 to about 11; normally by the addition of an acid (e.g., levulinic, acetic or malic acids) or a base (e.g., potassium hydroxide or sodium hydroxide) to the slurry. Buffers also can be employed to provide control of the pH range experienced by the slurry. Generally, the temperature of the slurry is maintained at about 25° C. to about 60° C., preferably about 40° C. to about 50° C. during extraction condition. The particular conditions of temperature and pH of the slurry can vary depending upon the particular enzyme which is employed, and selection of such conditions will be apparent to the skilled artisan. The time period over which extraction occurs typically ranges from about 30 minutes to 6 hours, frequently about 1 hour to about 3 hours.

The amount of enzyme relative to the tobacco material which is employed can vary. Generally, the amount of enzyme depends on factors such as the type of tobacco which is processed, the enzymatic treatment conditions (e.g., agitation rate of the slurry, and temperature and pH of the slurry), the amount of solvent relative to tobacco material, and the time over which enzymatic treatment conditions are carried out. Typically, the weight of tobacco material relative to enzyme for each enzyme treatment ranges from about 20:1 to about 200:1, frequently about 50:1 to about 150:1.

If desired, the tobacco material can be subjected to several enzymatic treatments under different treatment or extraction conditions. For example, the tobacco material can be subjected to one type of enzyme treatment under one particular temperature range and pH range; and then subjected to another type of enzyme treatment under another temperature range and pH range.

The activity of the enzyme terminated after the enzymatic treatment is complete (i.e., the enzyme is deactivated). Normally, the slurry is heated or otherwise processed to terminate the activity of the enzyme prior to the time that the liquid extract is separated from the insoluble tobacco pulp. The slurry can be heated using a steam jacket, or other suitable techniques.

The solvent and extract are separated from the extracted tobacco material using centrifugation techniques, filtration techniques, or the like. As such, an enzymatically treated insoluble residue is isolated from a liquid extract. Normally, the insoluble residue is separated from as much of the tobacco extract as is possible (e.g., by squeezing or pressing techniques, or by using a rotary press drum). If desired, a nozzle-type, high speed continuous centrifuge can be employed. If desired, the insoluble residue can be washed with water to provide for further collection of water soluble or dispersible tobacco components.

The solvent and extract then is collected. The collected solvent and extract is a liquid extract normally having a nonviscous character, is aromatic and is dark in color. The liquid extract normally includes about 10 to about 20, frequently about 12 to about 18 weight percent tobacco extract; and about 80 to about 90, frequently about 82 to 88 weight percent solvent. The liquid extract which is collected preferably includes less than about 5 weight percent, more preferably less than about 2 weight percent, and most preferably less than about 1 weight percent insoluble, precipitated or non-extract components.

The tobacco extract can be processed to have various forms. For example, it is desirable to subject the liquid extract to a spray drying, freeze drying, belt drying, flash drying, or other suitable solvent removal process in order to provide a tobacco extract in a substantially solvent-free form. As such, the tobacco extract can be processed to have the form of a paste, a viscous liquid, a powder, a granular solid, a gel, or the like. Tobacco extracts can be processed as described in U.S. Pat. Nos. 3,316,919 to Green and 5,005,593 to Fagg; European Patent Application No. 338,831; as well as U.S. patent application Ser. No. 680,207 filed Apr. 4, 1991. Typically, tobacco extracts are provided in the form of spray dried extracts, freeze dried extracts, tobacco essences, or the like.

The tobacco extract can be provided at a predetermined solvent level (e.g., in a predetermined high moisture form) by removing the solvent from the collected mixture of solvent and extract. Vacuum distillation, reverse osmosis and thin film evaporation techniques are particularly useful.

The tobacco extract can be subjected to heat treatment as described in U.S. patent application Ser. Nos. 452,175, filed Dec. 18, 1989; 536,250, filed Jun. 11, 1990; and 710,273, filed Jun. 4, 1991; which are incorporated herein by reference.

The tobacco extracts so provided are useful as forms of tobacco for smoking products. For example, such tobacco extracts are useful as casing or top dressing components for tobacco laminae and cut filler, as well as for other smokable materials. Such tobacco extracts can be employed as a form of tobacco in those types of smokable materials described in U.S. Pat. No. 4,920,990 to Lawrence, et al., and European Patent Application Nos. 280,990 and 419,733. Alternatively, such tobacco extracts are useful as one form of tobacco employed in those types of smoking articles described in U.S. Pat. Nos. 4,708,151 to Shelar; 4,771,795 to White, et al.; 4,714,082 to Banerjee, et al.; 4,756,318 to Clearman, et al.; 4,793,365 to Sensabaugh, et al.; 4,827,950 to Banerjee, et al.; 4,819,665 to Roberts, et al.; 4,854,311 to Banerjee, et al.; 4,881,556 to Clearman, et al.; 4,893,639 to White, et al.; 4,928,714 to Shannon; 4,938,238 to Barnes, et al.; 4,947,874 to Brooks, et al.; 4,955,399 to Potter, et al.; 4,991,596 to Lawrence, et al.; and 5,027,837 to Clearman, et al.; U.S. patent application Ser. No. 642,233, filed Jan. 23, 1991; and European Patent Application No. 342,538. The tobacco extracts are useful as cigarette filter additives. For example, the tobacco extracts can be incorporated into low density polyethylene and formed into strands; and then incorporated into cigarette filters as described in U.S. Pat. Nos. 4,281,671 to Bynre, et al. and 4,862,905 to Green, Jr., et al. The tobacco extracts are also useful in those smoking articles described in U.S. patent application Ser. Nos. 606,287, filed Nov. 11, 1990 and 621,499, filed Dec. 7, 1990. The tobacco extracts also are useful as cigarette wrapper additives; or as additives to the inner regions of cigarette packages (e.g., within a paper/foil laminate of a cigarette package or within a low density polyethylene film which is placed within a cigarette aroma and "pack aroma." See also, U.S. patent application Ser. No. 696,700, filed May 7, 1991.

The following examples are provided in order to further illustrate various embodiments of the invention but should not be construed as limiting the scope thereof. Unless otherwise noted, all parts and percentages are by weight.

EXAMPLE 1

Burley tobacco strip is finely ground to particles of average size of 60 U.S. mesh. The finely ground particles, having a moisture content of about 5 percent and weighing about 600 g, are dispersed in about 2500 ml of tap water maintained at about 40° C. to about 50° C. and containing an enzyme mix. The enzyme mix includes about 6 g Viscozyme 120L, about 3 g Pectinex 3X and about 1 g Fungamyl 800L, each of which are obtained from Novo Nordisk Bioindustrials Co. Then, the pH of the resulting slurry is adjusted to about 4.0 to about 5.0 using malic acid crystals. The slurry is maintained at about 40° C. to about 50° C. for about 3 hours, while the slurry is gently stirred using a mechanical stirrer. The slurry is open to ambient atmosphere during such period. Then, the slurry is heated rapidly (i.e., so as to heat the slurry to about 90° C. in about 15 minutes). The slurry is maintained at about 90° C. for about 5 minutes. Then, the slurry is cooled to about 60° C. by immersing the container containing the slurry in an ice bath for about 20 minutes. The slurry is centrifuged to obtain a tobacco extract within water, and a damp mixture comprising extracted tobacco material, water and tobacco extract. The damp mixture is pressed using mortar and pestle to remove a further amount of water and extract therefrom. About 1800 g of solvent and extract contained therein are collected, and the aqueous extract includes less than about 1 part insoluble tobacco solids, greater than about 85 parts water, and about 15 parts tobacco extract. The liquid extract is concentrated to about 25 to abut 40 percent extract using a rotovap evaporator at about 45° C. at about 30 in. Hg.

EXAMPLE 2

A blend of 50 parts flue-cured tobacco, 50 parts Maryland tobacco in strip form is finely ground to particles of average size of 60 U.S. mesh. The finely ground particles, having a moisture content of about 5 percent and weighing about 600 g, are dispersed in about 2500 ml of tap water maintained at about 30° C. to about 40° C. and containing an enzyme mix of lipases. The enzyme mix includes about 6 g Lipozyme 1000L which is obtained from Novo Nordisk Bioindustrials Co. Then, the pH of the resulting slurry is adjusted to about 7 using sodium hydroxide pellets. The slurry is maintained at about 30° C. to about 40° C. for about 1 hour, while the slurry is gently stirred using a mechanical stirrer. Then, the temperature of the slurry is raised to about 40° C. to about 50° C., and another enzyme mix is added thereto. The enzyme mix includes about 6 g Viscozyme 120L, about 3 g Pectinex 3X and about 1 g Fungamyl 800L, each of which are obtained from Novo Nordisk Bioindustrials Co. Then, the pH of the resulting slurry is adjusted to about 4.0 to about 5.0 using malic acid crystals. The slurry is maintained at about 40° C. to about 50° C. for about 2 hours, while the slurry is gently stirred using mechanical stirrer. The slurry is open to ambient atmosphere during such period. Then, the slurry is heated rapidly (i.e., so as to heat the slurry to about 90° C. in about 15 minutes). The slurry is maintained at about 90° C. for about 5 minutes. Then, the slurry is cooled to about 60° C.. The slurry is centrifuged to obtain a tobacco extract within water, and a damp mixture comprising extracted tobacco material, water and tobacco extract. The damp mixture is pressed using a mortar and pestle and to remove a further amount of water and extract therefrom. About 1800 g of solvent and extract contained therein are collected, and the aqueous extract includes greater than about 82 parts water, less than about 1 part insoluble tobacco solids, and about 17 parts tobacco extract.

EXAMPLE 3

Tobacco in the form of Burley stems is finely ground to particles of average size of 60 mesh. The finely ground particles, having a moisture content of 4 to 7% weighing about 600 g, are dispersed in about 2500 ml of tap water maintained at about 30° C. to about 40° C. and containing an enzyme. Six grams of Lipozyme 10,000L containing a mixture of lipases obtained from Novo Nordisk Bioindustrials is utilized in the reaction. Then, the pH of the resulting slurry is adjusted to about 7 using sodium hydroxide. The slurry is maintained at about 30° C. to about 40° C. for about 1 hour, while the slurry is gently stirred using a mechanized stirrer. Temperature of the slurry is adjusted to about 40° C. to about 50° C., and the pH is lowered with malic acid to about 4 to 5 and an enzyme mix is added thereto. The enzyme mix includes about 6 g Viscozyme 120L, about 3 g Pectinex 3X and about 1 g Fungamyl 800L, each obtained from Novo Nordisk Bioindustrials Co. The slurry is maintained at about 40° C. to 50° C. for about 2 hours, while the slurry is gently stirred using a mechanical stirrer. The slurry is open to ambient atmosphere during such a period. Then, the slurry is heated rapidly (i.e., so as to heat the slurry to about 90° C. in about 15 minutes). The slurry is maintained at about 90° C. for about 5 minutes. Then the slurry is centrifuged using a table top lab centrifuge to obtain a tobacco extract within water, and a damp mixture comprising extracted tobacco material, water and tobacco extract. The damp mixture is pressed using a mortar and pestle to remove a further amount of water and extract therefrom. About 1800 g of solvent and extract contained therein are collected, and the aqueous extract includes greater than about 87 parts water, less than about 1 part insoluble tobacco solids, and 12 parts extract.

What is claimed is:

1. A process for providing a tobacco extract, the process comprising the steps of:

(a) subjecting a tobacco material to extraction conditions in the presence of an extraction solvent and at least one active enzyme, wherein the extraction conditions comprise maintaining the pH at about 4.0 to about 5.0 and maintaining the temperature at about 40° C. to about 50° C.;

(b) separating solvent and tobacco extract therein from tobacco material not extracted by the solvent; and (c) collecting solvent and tobacco extract therein.

2. The process of claim 1 whereby the extraction solvent is a liquid having an aqueous character.

3. The process of claim 2 whereby the liquid having an aqueous character is essentially pure water.

4. The process of claims 1 or 2 whereby the enzyme is selected from the group consisting of cellulases, hemicellulases, arbanases, B-glucanases, xylanases, pectinesteroses, pectintranseliminases, polygalacturonases, alpha-amylases, lipases and mixtures thereof.

5. The process of claims 1 or 2 whereby the weight of tobacco material relative to enzyme is from about 20:1 to about 200:1.

6. The process of claims 1 or 2 whereby step (a) includes terminating the activity of the enzyme.

* * * * *